United States Patent [19]

Sorenson et al.

[11] Patent Number: 4,767,899

[45] Date of Patent: Aug. 30, 1988

[54] MAKE BEFORE BREAK ELECTRICAL SWITCH

[75] Inventors: Richard W. Sorenson, Avon; Milton N. Ives, Wolcott, both of Conn.

[73] Assignee: Carlingswitch, Inc., West Hartford, Conn.

[21] Appl. No.: 27,738

[22] Filed: Mar. 19, 1987

[51] Int. Cl.[4] ..... H01H 33/04

[52] U.S. Cl. ..... 200/144 R; 200/68.2; 200/67 A

[58] Field of Search ..... 200/144 R, 68.2, 67 A

[56] References Cited

U.S. PATENT DOCUMENTS 1,964,561 6/1934 Douglas ..... 200/68.2

3,670,116 6/1972 Cryer ..... 200/68.2

*Primary Examiner*—Robert S. Macon

*Attorney, Agent, or Firm*—McCormick, Paulding and Huber

[57] ABSTRACT

A make before break switch having two opposed fixed contacts separately closed by a pivotal contact lever. A center fixed contact supports the lever for movement both pivotally and vertically so that the contact lever closes on both said two fixed contacts in an intermediate position. A conventional actuator means and spring biasing means controls the contact lever as it is so moved, and a secondary biasing means is provided below the lever to allow the make before break action as the actuating means moves through its intermediate position.

4 Claims, 2 Drawing Sheets

MAKE BEFORE BREAK ELECTRICAL SWITCH

BACKGROUND

This invention relates generally to electrical switches of the type wherein contact is maintained for one circuit condition prior to the time when a second circuit is closed.

Make before break switches are useful in applications where electrical noise must be minimized, such noise being generated by conventional break before make type of switch. The chief aim of the present invention is to provide an efficient make before break electrical switch of relatively straight-forward construction, using components typical of a more conventional break before make electrical switch.

In accordance with the present invention a conventional switch case is provided with a conventional actuator means such that a contact lever can be shifted between opposed limit positions to define ON positions for the two interrelated circuits. The housing has a bottom wall with fixed contacts provided in longitudinally spaced relationship in the bottom wall and the center one of the fixed contacts intermediate the other two supports the contact lever so that the lever pivots about a lateral axis that is movable vertically relative to the center fixed contact. The contact lever has opposed end portions adapted to abut the two outside fixed contacts and the actuator serves to shift the contact lever between these two limit positions. However, as the contact lever is moved by the actuator through an intermediate position the contact lever is biased downwardly to remain in contact with both of these outside fixed contacts. The actuator means includes a conventional first biasing means to provide continuous contact between the contact lever and a lower tip portion of the actuator means. A second spring biasing means is provided between the underside of the contact lever and fixed structure within the switch case housing to provide a biasing force upwardly on the contact lever that is counteracted by the actuator means as it is moved through the above mentioned intermediate position.

DETAILED DESCRIPTION OF THE DRAWINGS

Figure 1:
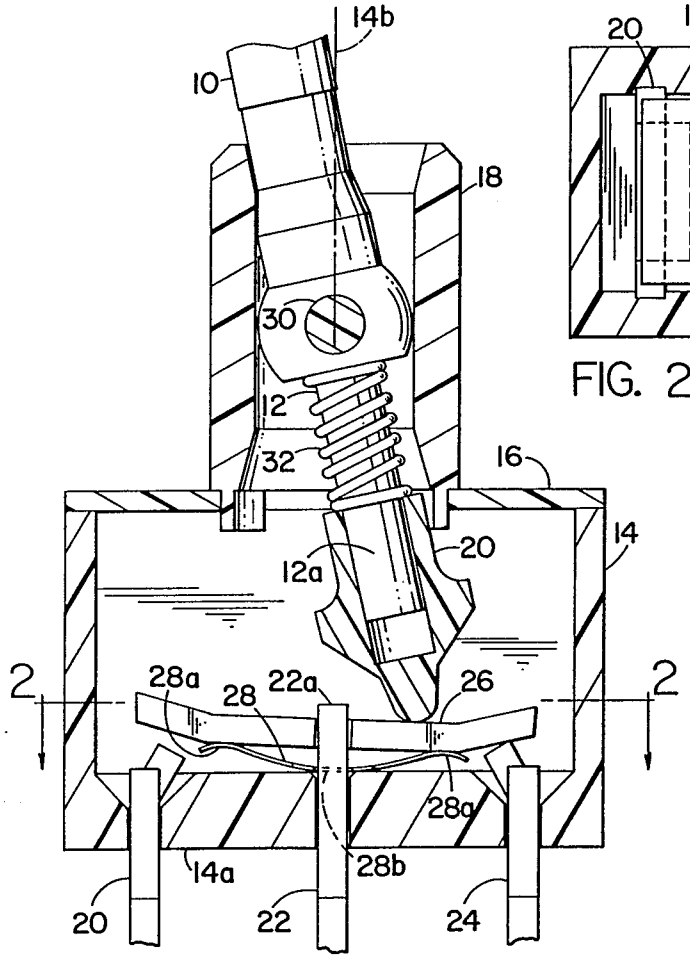
FIG. 1 is a vertical sectional view taken through a switch constructed in accordance with the present invention.

Turning now to the drawings in greater detail FIG. 1 illustrates a toggle switch incorporating the present invention, the toggle 10 being shown broken away and including a lower actuator means portion 12 extending downwardly into a switch case housing that includes case 14, cover 16, and switch case mounting boss 18 all of which components are assembled in conventional fashion to provide the housing for a switch mechanism of the present invention.

Figure 2:
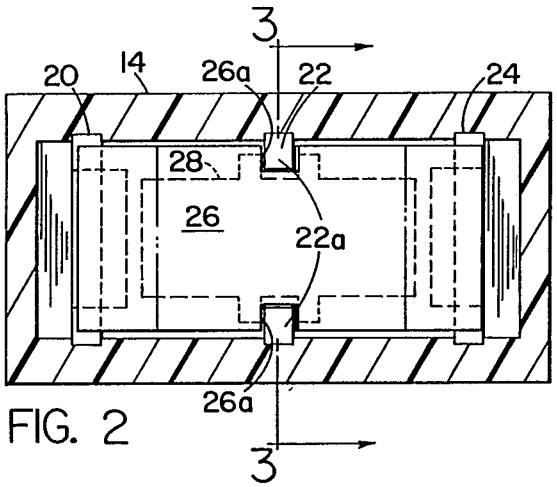
FIG. 2 is a horizontal sectional view taken generally on the line 2—2 of FIG. 1.
Figure 3:
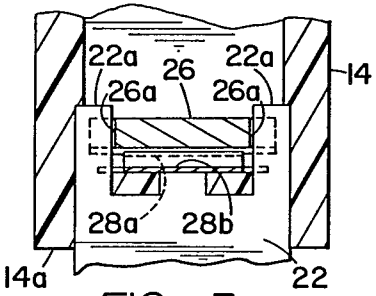
FIG. 3 is a vertical section taken generally on the line 3—3 of FIG. 2.

The switch case 14 has a bottom wall 14*a* in which bottom wall there is provided a plurality, preferably three, fixed contacts 20, 22 and 24. The center fixed contact 22 extends upwardly and inwardly of the housing 14 and is located on the center line 14*b* of the housing. As best shown in FIG. 3 the center fixed contact 22 defines an upwardly open notch to receive a movable contact lever 26. The contact lever 26 includes laterally outwardly open notches 26*a* that are aligned with one another to receive the upstanding end portions 22*a* of the center fixed contact 22 as shown in FIG. 2. The contact lever 26 is capable of pivoting from the position shown in FIGS. 1 and 4 to the broken line position illustrated in FIG. 4. In accordance with the present invention the contact lever 26 is also capable of limited vertical movement relative to the center fixed contact 22. The upwardly directed biasing force exerted by the leaf spring 28 of FIG. 1 is overcome by the actuator means as the tip portion 20 moves through the broken line position of FIG. 5.

Figure 4:
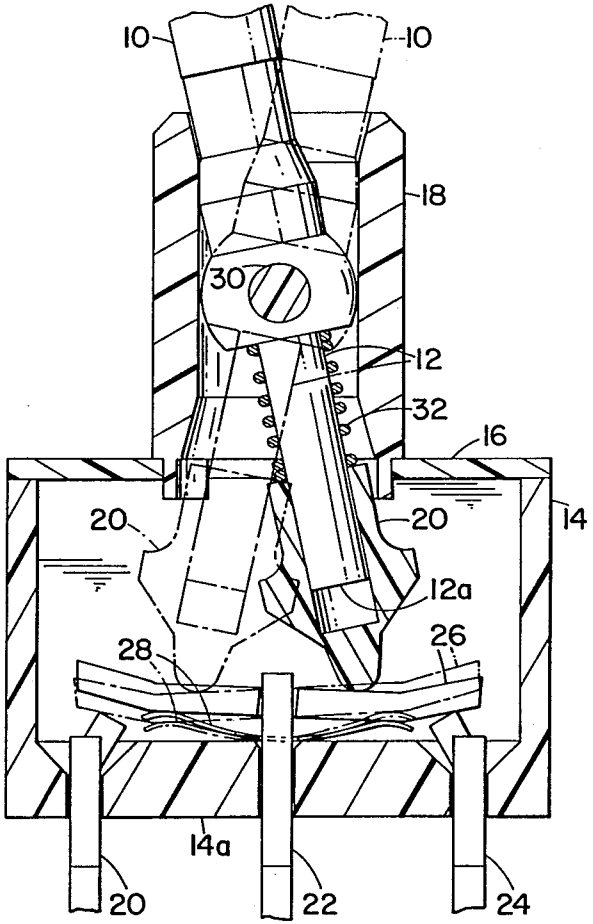
FIG. 4 is a view similar to FIG. 1 but illustrating the actuator means and contact lever in a broken line position that is a mirror image of that shown in full lines.

The actuator means 12 and associated toggle 10 and tip portion 20 comprise an operator for the switch and actuator means 12 is pivotally mounted in boss 18 by a cross-pin 30 so that the toggle 10 can be moved from the position shown in FIG. 1 to an opposite or mirror image position as suggested by the broken lines 20 in FIG. 4. The actuator means includes a first coil spring biasing means 32 acting between a downwardly facing flange on the toggle 10 and an upper surface of tip 20. The tip 20 includes a lowermost end portion for engaging a selected region of the movable contact lever 26. The tip 20 is slideably received on a depending portion 12*a* of the toggle/actuator. This conventional toggle geometry provides a continuously directed downward force on the contact lever 26 as the toggle/actuator is moved between the limit positions shown in FIG. 4.

Figure 5:
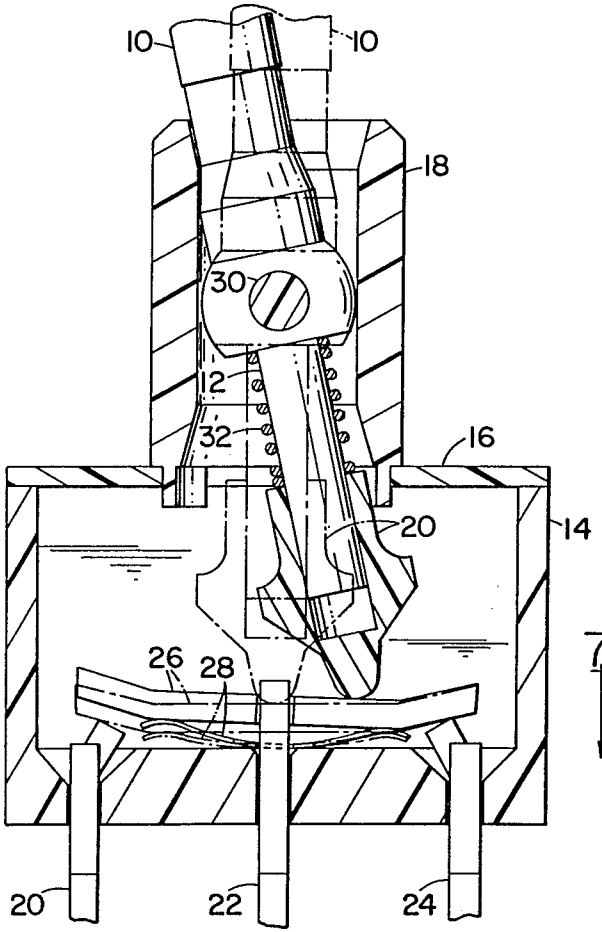
FIG. 5 is a view similar to FIG. 4 but illustrating the actuator means and contact lever in broken lines at a position intermediate the solid line position shown in FIGS. 1, 4 and 5 and opposite the mirror image position thereof.

It is an important feature of the present invention that this downwardly directed force exerted by the actuator tip 20 on the contact lever 26 be sufficiently high to overcome the upwardly acting force exerted by the secondary biasing means or leaf spring 28 as described previously. FIG. 5 shows the results of such spring characteristics and illustrates the tip portion of the actuator means 20 in broken lines at an intermediate position between the limit positions of FIG. 4. The contact lever 26 is also shown in a broken line position in FIG. 4 such that the opposed end portions of the lever 26 are in contact with both outside fixed contacts 20 and 24 at the same time. Thus, the switch shown in FIGS. 1 through 5 provides a positive ON position capable of closing two interrelated electrical circuits each of which must be switched in such a manner that one circuit is not allowed to open before the other is closed.

FIGS. 1, 2 and 3 illustrate the geometry for the leaf spring 28. Opposed end portions 28*a* are so shaped as to engage the underside of the contact lever 26 generally between the outer fixed contacts 20 and 24 respectively and the center fixed contact 22. An intermediate portion **28*b* of the leaf spring 28 engages fixed structure within the switch case housing and more particularly engages the center fixed contact 22 as suggested in FIG. 3. As so constructed and arranged the leaf spring 28 exerts an upwardly directed controlled force on the movable contact lever 26 during its movement between the opposed limit positions of FIG. 4, which upwardly directed force can be overcome by the downwardly directed biasing force of the stronger spring 32 provided for this purpose in the actuator means 12. Thus, when the actuator means passes through the intermediate position shown in broken lines in FIG. 5, and during a predetermined range of actuator means travel or motion including the mid-position shown in broken lines in FIG. 5, the contact lever 26 remains in contact with the two outside fixed contacts 20 and 24 so that one or the other of these fixed contacts 24 and 20 is always connected electrically to the center contact 22**.

Figure 7:
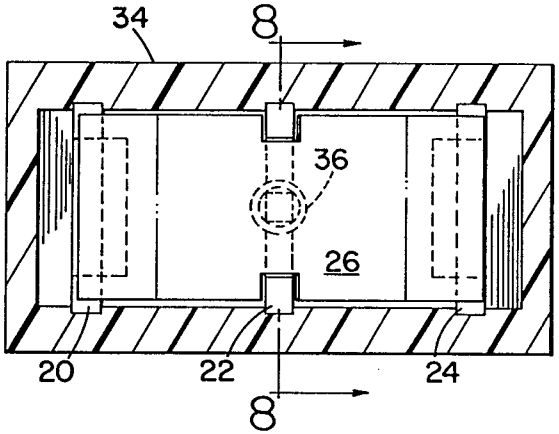
FIG. 7 is a horizontal section taken generally on the line 7—7 of FIG. 6.
Figure 8:
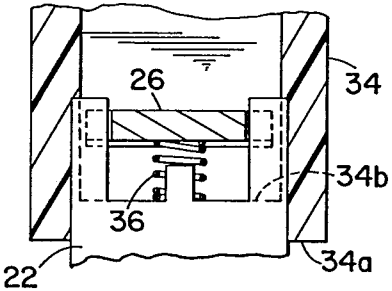
FIG. 8 is a vertical section taken generally on the line 8—8 of FIG. 7.
Figure 6:
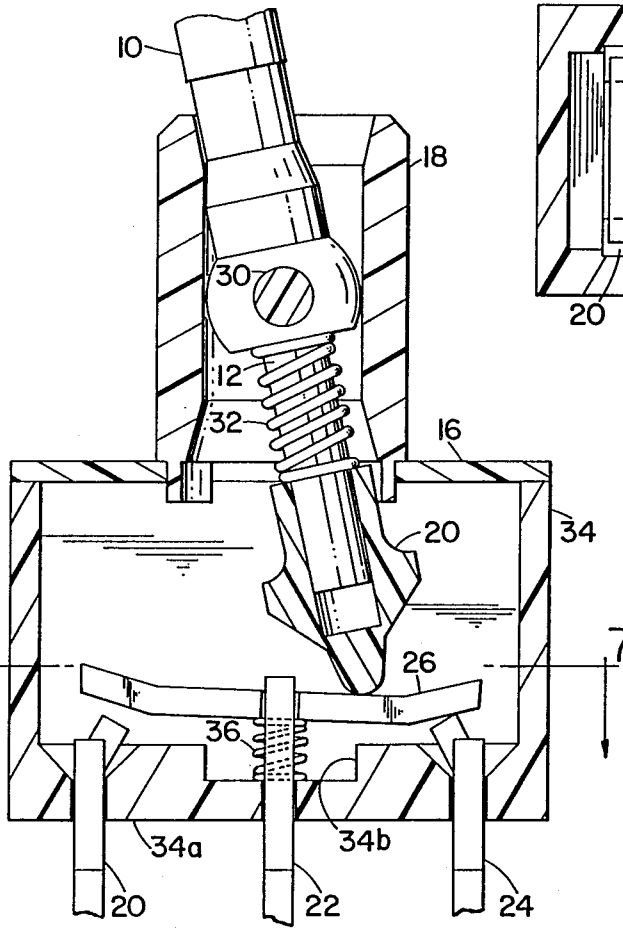
FIG. 6 is a vertical section through a switch similar to that of FIGS. 1 through 5 but with a slightly different geometry for the secondary spring biasing means acting on the underside of the contact lever.

Turning now to a detailed description of the embodiment illustrated in FIGS. 6, 7 and 8, many of the same switch components are provided in this alternative switch configuration and therefore the same reference numerals are carried over to call attention to this commonality.

In place of the leaf spring 28 in the above-described embodiment of FIGS. 1 through 5, a coil spring 36 is provided between the fixed switch case housing structure and the underside of movable contact lever 26. The spring 36 serves the same purpose as the leaf spring 28 and provides secondary biasing means to be overcome by the first biasing means 32 of the actuator means 12 all as described herein above. The switch case housing 34 may be of slightly different geometry as depicted generally by the cavity **34*b* provided for the spring 36 in the bottom wall 34*a*. The lower end of coil spring 36 acts against the center fixed contact 22 and the upper end acts on the underside of the movable contact lever 26 in the same manner as was true of the leaf spring 28 described above. In operation the switch of FIGS. 6, and 8 functions in a generally similar manner to that of FIGS. 1 through 5, and as best shown in FIGS. 4 and 5 the lever 26 will move through the same positions as depicted in these views. That is, the lever 26 will remain in contact with one or the other of the two outside fixed contacts 20 and 24 until the actuator tip 20** has passed the intermediate or center position assuring that a make before break switch condition is achieved.

Although the two embodiments shown and described here illustrate the invention in a single pole switch it will be apparent that the invention is also well adapted for incorporation in a double pole switch wherein the actuator means has two side-by-side contact lever engaging tip portions for contacting two side-by-side levers in a housing having side-by-side switch cavities in a single housing.

We claim:

1. An electric make before break switch comprising a housing with a bottom wall, fixed contacts provided in longitudinally spaced relationship in said bottom wall, a center one of said fixed contacts provided intermediate two outside fixed contacts, a movable contact lever supported by said fixed center contact for pivotal movement between opposed limit positons and for limited movement toward and away from said housing bottom wall, said movable contact lever having opposed ends adapted to abut said other fixed contacts, actuator means including a contact lever engaging portion, said actuator means pivotably mounted in said housing for movement between opposed limit positions corresponding to opposed contact lever positions wherein the opposed ends of said lever selectively engage said other fixed contacts, said actuator means including first spring biasing means for acting on said lever engaging portion to urge said portion into sliding engagement with a selected region of said lever during such actuator means movement, and secondary spring biasing means acting upon said contact lever to urge said lever upwardly, said secondary biasing means exerting an upwardly directed force on said contact lever that is overcome by the downward force of said first biasing means acting on said lever engaging portion at least when said lever engaging portion is positioned intermediate said opposed limit positions.

2. The switch of claim 1 wherein said actuator means includes an operator portion extending outwardly of the switch case housing and a lower portion extending inwardly toward said bottom wall, said actuator means lever engaging portion comprising a tip slideably received on said lower actuating means portion, said first spring biasing means comprising a coiled compression spring acting between a downwardly facing flange of said actuator means and said tip to maintain sliding engagement between the tip and the contact lever, said center fixed contact having a bifurcated upper end defining an upwardly open notch between laterally spaced furcations, said contact lever having laterally opposed notches located at its laterally extending midpoint for loosely receiving said furcations of said center contact, and said lever selected region defined symmetrically between said opposed notches, said secondary spring means provided below said selected contact lever region and between said furcations of said center fixed contacts to urge said lever upwardly with a biasing force acting on said lever at or adjacent to the levers lateral mid point.

3. The switch of claim 2 wherein said secondary biasing means comprises a leaf spring having end portions and having a mid portion between said end portions, said leaf spring portions acting on said contact lever and on a portion of said fixed contact between said laterally spaced furcations.

4. The switch of claim 2 wherein said secondary biasing means comprises a coiled compression spring acting between the underside of said lever and a portion of said fixed contact between said laterally spaced furcations.

* * * * *